US005270671A

United States Patent [19]

Waterman

[11] Patent Number: 5,270,671

[45] Date of Patent: Dec. 14, 1993

[54] NEGATIVE SLOPE PHASE SKEWER

[75] Inventor: Timothy G. Waterman, Eldersburg, Md.

[73] Assignee: Westinghouse Electric Corp., Pittsburgh, Pa.

[21] Appl. No.: 925,846

[22] Filed: Aug. 7, 1992

[51] Int. Cl.[5] ..... H01P 1/18; H01P 3/08

[52] U.S. Cl. ..... 333/161; 333/116; 333/156; 343/700 MS

[58] Field of Search ..... 333/116, 117, 156, 161, 333/164, 263; 343/700 MS; 342/368-375

[56] References Cited

U.S. PATENT DOCUMENTS 4,127,831 11/1978 Riblet ..... 333/116 X
5,023,866 6/1991 DeMuro ..... 333/126 X
5,043,738 8/1991 Shapiro et al. ..... 343/829 X

*Primary Examiner*—Robert J. Pascal

*Assistant Examiner*—Seung Ham

*Attorney, Agent, or Firm*—Eugene LeDonne

[57] ABSTRACT

A negative slope phase skewer for use between radiating elements of series fed antenna array. The phase skewer has a four part coupler having two segments lying parallel to one another, each segment being a near and a far branch. The two near branches connect to the transmission line, while the far branches are at some distance from the transmission line. A series of spaced apart, progressively longer, high impedance open circuited stubs extends outward perpendicularly from each far branch. Two conductive connections connect the two segments between the transmission line and the stubs. Each stub is designed to be one quarter wavelength long of an average frequency in a band region of an operating band width, and are spaced apart by a quarter wavelength of the midpoint of the operating band.

5 Claims, 1 Drawing Sheet

NEGATIVE SLOPE PHASE SKEWER

BACKGROUND OF THE INVENTION

1. Field of the Invention

This invention relates generally to the field of microwave transmission and more particularly to a means of aligning the phase of signals at radiating elements of a series fed antenna.

2. Description of the Prior Art

Transmission lines that carry electromagnetic signals have a given, fixed length, thus, a signal of a given frequency will have a certain phase or degrees per unit length associated with it. As the frequency of the transmitted signal increases, the number of degrees increases as well for a given length of time. Therefore, at specific locations along the transmission line the phase angle at these locations will change relative to one other when the frequency of the signal is changed. This relative phase difference at transmission line locations is detrimental for some electromagnetic signal applications.

One application in which relative phase angle differences at predetermined locations is a particular drawback is in the field of array antennas. There are two common types of array antennas, a series fed antenna and a corporate fed antenna. A corporate fed antenna generally has one input and the signal from this input passes through a divider which feeds all the radiating elements approximately in phase. Another type of array antenna is a series fed antenna which is generally one long transmission line having the radiating elements spaced along the line in succession. In the case of a corporate fed antenna, as the frequency of the signal is changed the phase at each radiating element although changed remain equal to one another. Despite the advantage of a consistent beam location through a range of frequencies, a corporate fed antenna does have the disadvantage of being more complicated than a series fed antenna.

A series fed array antenna consists of a long transmission line having a plurality of radiating elements arranged in series along the transmission line. As a signal travels down the transmission line, a portion of the signal is radiated out of each radiating element in succession. Because each radiating element is spaced at some line length from the other radiating elements, each radiating element will have a certain phase associated with it. The radiating elements each generate a radiation pattern. And because the composite antenna radiation pattern is determined by superimposing the fields of each radiating element, the shape and direction of the antenna radiation pattern is determined by the relative phases and amplitudes of the currents at the individual radiating elements. By properly varying the relative phases, it is possible to steer the direction of the radiation. If the frequency of a signal is changed for one reason or another, the phase at each radiating element will necessarily change. When a frequency of the signals traveling through the array is chosen such that the same phase is applied at all radiating elements, the relative phase difference between adjacent elements is zero and the position of the main beam will be broadside to the array. When the phase applied to the radiating elements are not identical such that the relative phase difference between elements is some value other than zero, the radiation pattern will change and the beam will point in a direction other than broadside. This condition is called squint.

It is known to undo squint through the use of a microprocessor. However, the hardware needed for processing out the squint is expensive. Thus, a means is needed in a series fed antenna for preventing squint. This means should be relatively inexpensive and should preclude the need for a microprocessor.

SUMMARY OF THE INVENTION

We provide a negative slope phase skewer that is particularly useful for placement along a transmission line between radiating elements of a series fed antenna array. The phase skewer is capable of generating a phase change in a signal in which the amount of phase change varies with the frequency of the signal. The phase skewer has a four-port coupler. The four-port coupler has two segments that lie parallel to one another, each segments having a near branch and a far branch. The two near branches of each segment connect to the transmission line. One near branch receives the input signal from the transmission line, the other near branch returns the signal to the transmission line as output. The two far branches lie opposite from the two near branches. A series of spaced apart, progressively longer, high impedance open circuited stubs extends outward perpendicularly from each far branch. Two conductive connections connect the two segments between the transmission line and the stubs.

In operation the negative slope phase skewer is placed along a transmission line. In one application the phase skewer is placed between radiating elements of an array antenna that operates in a given bandwidth. The operating bandwidth is divided into a selected number of regions, with each region including a portion of the frequencies in the bandwidth. The phase skewer is designed so that a stub is provided for each band region. Each stub is designed to be approximately one quarter wavelength long for the average frequency in its corresponding band region. The stubs are also spaced-apart by a quarter wavelength of the midpoint of the operating band. A signal of a given frequency travels into the input near branch of the phase skewer and the coupler causes a portion of the incoming signal to travel into each far branch. When the signal halves travel to the open circuit stub that is a quarter wavelength of the transmitted signal, which is resonant for that signal, the signal is reflected from the open circuit of that stub. The reflected signal then travels out of the output near branch and back to the transmission line.

Since the shorter stubs are located more proximate to where the input near branch and output near branch of the skewer connect to the transmission line, the higher frequency signals. Thus, they reflect back sooner than do the low frequency signals. Therefore, signals having higher frequencies are reflected out of the phase skewer sooner than do signals having lower frequencies. This means that the phase skewer provides a shorter path for the smaller wavelength, higher frequency signals and a longer path for the longer wavelength, lower frequency signals. And since the smaller wavelengths have a shorter path and the longer wavelengths have a longer path to their destination, the signals arrive at each radiating element in the same phase. Thus, the skewer causes a lower frequency signal to have a longer phase length and causes a higher frequency signal to have a shorter phase length. This allows the signals at each radiating element to remain in phase when the frequencies are varied.

DESCRIPTION OF THE PREFERRED EMBODIMENT

Figure 1:
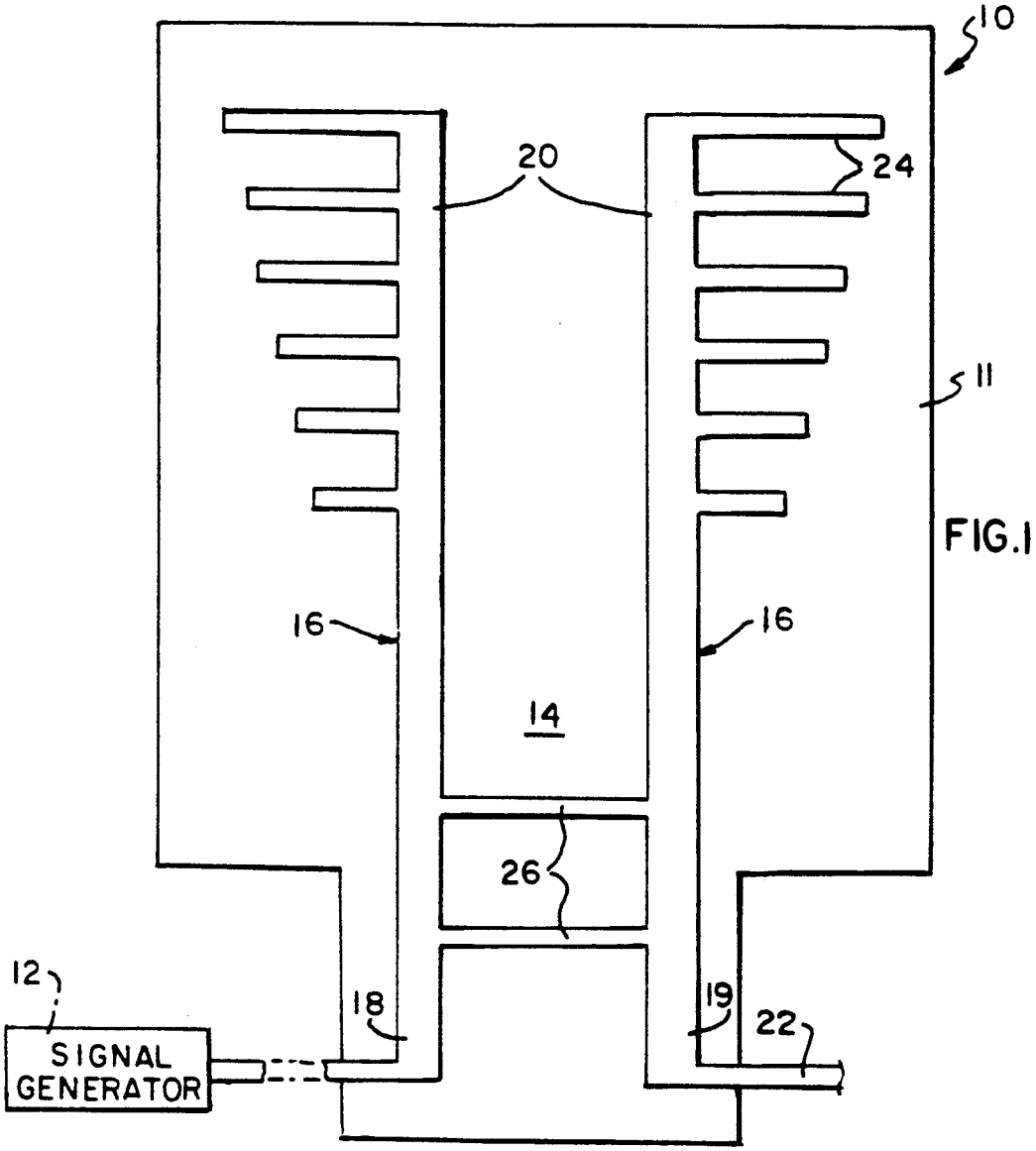
FIG. 1 is a top view of the present preferred skewer.
Figure 2:
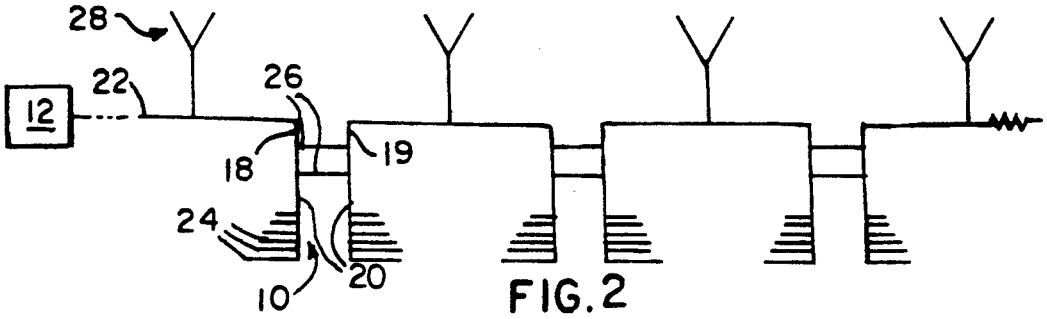
FIG. 2 is a schematic view of several present preferred skewers positioned between radiating elements of a series fed array.

Referring to FIGS. 1 and 2, a preferred embodiment of a negative slope phase skewer 10 is shown. The phase skewer enables the phase of a signal to be changed by different amounts for different frequencies. The skewer may be incorporated in any transmission line, however, the preferred embodiment incorporates the phase skewer as a center conductor for a strip line transmission line. Thus, the phase skewer 10 is preferably situated between outer conductor plates 11 only one of which is shown in FIG. 1.

The phase skewer 10 is positioned along a stretch of transmission line 22 having a signal generator 12 placed at some point on the transmission line. The signal generator generates signals of various frequencies in an operating band. The operating band has an upper limit of frequencies, a lower limit of frequencies and a midpoint. The phase skewer 10 is particularly useful when placed between adjacent pairs of radiating elements 28 such as an array antenna.

Phase skewer 10 consists of a four-port coupler 14 having a series of stubs extending from opposed branches. A −3dB branch line coupler is preferred as the coupler 14 because of symmetry and integral construction, however, any four-port coupler can be used. The coupler 14 is made of a conductive material such as aluminum. The coupler 14 has two elongated segments 16. The segments 16 lie parallel to and are spaced apart from one another.

The segments 16 each have a near branch and a far branch 20. The near branch of the coupler 14 that is located closest to the signal source 12 on the transmission line 22 is the input near branch 18. The signal enters the phase skewer 10 at the input near branch 18. The near branch of the coupler 14 that is located most remote to the signal source 12 is the output near branch 19. The signal exits the phase skewer 10 and returns to the transmission line 22 through the output near branch 19. Two connections 26 that are a quarter wavelength of the midpoint of the operating band in length, parallel to and spaced a quarter wavelength of the operating band midpoint apart from one another, connect the segments 16. The connections 26 are made of a conductive material such as aluminum. Connections 26 are perpendicular to segments 16 and connect the segments 16 at a point along the segments 16 between the stubs 24 and the transmission line 22. Each far branch 20 has a series of high impedance open-circuited stubs 24 attached to it. Stubs 24 extend outward perpendicularly from the far branches 20. Stubs 24 are of progressively increasing length. Preferably, the stubs 24 in each series lie in a common plane.

The radiating elements 28 of the antenna array are designed to operated over a range or band of frequencies. The stub 24 most proximate to the transmission line 22 is designed to be the shortest of the stubs and the stub 24 that is most distant from the transmission line 22 is designed to be the longest stub. The remaining stubs increase in length progressively from the shortest stub to the longest stub. Each stub 24 is designed to be a quarter of a wavelength for a signal having a given frequency. The shortest stub 24 is designed to be a quarter of a wavelength of the frequency at the high end of the operating band. Similarly, the longest stub 24 is designed to be a quarter wavelength at the low end of the operating band.

The operating bandwidth in which the phase skewer is utilized is divided into a predetermined number of regions, which for the purpose of illustrating the concept, was chosen as six for the phase skewer of FIGS. 1 and 2. Each region includes a range of frequencies in the band. A stub 24 is provided for each region of the band. Since six regions of the operating band are chosen, six stubs 24 are employed with each stub being approximately one quarter the median wavelength of the signals in its respective region.

In operation, a signal of a given wavelength travels down the transmission line 22 between radiating elements 28 and enters the input near branch 18 of the phase skewer 10. The signal then travels through the phase skewer 10 to the far branches 20 until it reaches a stub 24 whose length is one quarter of the wavelength of the signal. When the stub 24 is a quarter wavelength of the transmitted signal, the stub 24 is resonant to the signal at that frequency. When the stub 24 is resonant to the signal, the signal travels through that sub 24 and is reflected at the open circuit of that stub 24. The reflected signal then travels out the output near branch 19 into the transmission line 22.

The coupler 14 operates to split the incoming wave by phase shift. Thus, half of the incoming signal is sent to one far branch 20 and its corresponding set of stubs 24 and the other half of the signal is sent to the other far branch 20 and its corresponding set of stubs 24. Each portion of the signal then reflects off its respective stub 24 and the portions of the signal are then recombined by the coupler as they leave the phase skewer 10.

The distance between a particular stub 24 and the transmission line 22 is selected so that the signal at which the particular stub 24 is resonant travels a specific path length. The path length is chosen for each frequency so that the signal arrives at some predetermined point in the transmission line 22 with a given phase angle. All other stubs 24 are located so that the signal at which those stubs 24 are resonant arrive at that same predetermined point with the same phase angle.

Therefore, since higher frequency signals will be reflected from the shorter stubs 24, and since the shorter stubs are located more proximate to the transmission line 22, the higher frequency signals will travel a relatively short path. Conversely, lower frequency signals will be reflected from the longer stubs 24, and since the longer stubs 24 are located distal to the transmission line 22, the lower frequency signals will travel a relatively long path. The net effect of the longer wavelength signals traveling a longer path and the shorter wavelength signals traveling a shorter path is that the signals arrive at the end of each path with the same phase. Thus, for predetermined points on the transmission line 22, a given phase may be obtained no matter what frequency of signal is chosen.

Variations of the preferred embodiment are possible. For example, although six stubs 24 were chosen for the phase skewer 10, any number of stubs will work.

Also, although the phase skewer is preferably employed as a center conductor in a strip line, the phase skewer could be employed with waveguides, microstrip circuitry or balanced line transmission means.

While certain present preferred embodiments have been shown and described, it is distinctly understood that the invention is not limited thereto but may be otherwise embodied within the scope of the following claims.

I claim:

1. A phase skewer for placement along a transmission line in which signals of various frequencies in an operating frequency band having a midpoint are transmitted along the transmission line, said phase skewer comprising;

(a) a four port coupler including:

(i) a first segment and a second segment, wherein:

said first and second segments include a near branch and a far branch, said first segment is parallel to said second segment, and said near branches on said first and second segments are connected to the transmission line;

(ii) two parallel conductive connections for connecting sad first segment to said second segment, wherein:

said connections each have a length of a quarter wavelength of the midpoint of the operating frequency band, and said connections are spaced-apart by a quarter wavelength of the midpoint of the operating frequency band; and (b) a plurality of spaced-apart, open circuited stubs, which extend outwardly from each of said far branches, wherein:

(i) a stub most proximate to the transmission line has a selected length and each succeeding stub has a progressively longer length, and;

(ii) each stub is one quarter of a wavelength of a signal in the transmission line having a selected frequency.

2. The phase skewer of claim 1 wherein said four-port coupler is a −3dB coupler.

3. The phase skewer of claim 1 wherein the operating frequency band is defined by six frequency ranges and said plurality of stubs is defined by six stubs, said six stubs respectively having a length equal to one quarter of a median wavelength of the six frequency ranges.

4. The phase skewer of claim 1 wherein the stubs in each series lie in a common plane.

5. An antenna array with a transmission line having a plurality of radiating elements serially spaced along the transmission line, wherein a phase skewer is placed between the radiating elements and the transmission line transmits signals with various frequencies that operate within a frequency band having a midpoint, said phase skewer comprising;

(a) a four port coupler including:

(i) a first segment and a second segment, wherein:

said first and second segments include a near branch and a far branch, said first segment is parallel to said second segment. and said near branches on said first and second segments are connected to the transmission line;

(ii) two parallel conductive connections for connecting said first segment to said second segment, wherein:

said connections each have a length of a quarter wavelength of the midpoint of the frequency band, and said connections are spaced-apart by a quarter wavelength of the midpoint of the frequency band; and (b) a plurality of spaced-apart, open circuited stubs, which extend outwardly from each of said far branches, wherein;

(i) a stub most proximate to the transmission line has a selected length and each succeeding stub has a progressively longer length, and;

(ii) each stub is one quarter of a wavelength of a signal in the transmission line having a selected frequency.

* * * * *